United States Patent [19]

Myer

[11] Patent Number: 4,636,801

[45] Date of Patent: Jan. 13, 1987

[54] MULTIPLE REFLECTOR SYSTEM WITH DIELECTRIC SUPPORT WEBS AND FOAM BODY

[75] Inventor: Jon H. Myer, Woodland Hills, Calif.

[73] Assignee: Hughes Aircraft Company, Los Angeles, Calif.

[21] Appl. No.: 486,143

[22] Filed: Apr. 18, 1983

[51] Int. Cl.[4] ..... H01Q 1/12

[52] U.S. Cl. ..... 343/781 CA; 343/912

[58] Field of Search ..... 343/781 CA, 781 P, 840, 343/912, 878, 885, 887, 915

[56] References Cited

U.S. PATENT DOCUMENTS

| | | | |
|---|---|---|---|
| 2,895,131 | 7/1959 | Butler | 343/840 |
| 2,940,078 | 6/1960 | Bodmer et al. | 343/840 |
| 2,945,233 | 7/1960 | Wild et al. | 343/840 |
| 3,296,685 | 1/1967 | Suliteanu | 343/912 |
| 3,374,482 | 3/1968 | Kielman | 343/912 |
| 3,407,404 | 10/1968 | Cook et al. | 343/765 |
| 3,438,045 | 4/1969 | Braccini | 343/781 CA |
| 3,983,560 | 9/1976 | MacDougall | 343/781 CA |

FOREIGN PATENT DOCUMENTS

| | | | |
|---|---|---|---|
| 474214 | 10/1937 | United Kingdom . | |
| 1162312 | 8/1969 | United Kingdom | 343/781 CA |
| 2081023 | 2/1982 | United Kingdom . | |

OTHER PUBLICATIONS

Japan Electronic Engineering, No. 38, Jan. 1970, Dempa (Tokyo, JP), T. Kitsuregawa: "Recent Parabolic Antenna Techniques".

Telecommunications and Radio Engineering, vol. 34, No. 12, Dec. 1979 (Silver Spring, Maryland, US) A. M. Pokras: "Satellite Communication Ground Station Antennas".

1968 International Antenna and Propagation Symposium, Boston, Digest, IEEE (New York, US), P. Mikulich et al: A High Gain Cassegrain Monopulse Antenna".

*Primary Examiner*—Eli Lieberman
*Assistant Examiner*—Michael C. Wimer
*Attorney, Agent, or Firm*—V. D. Duraiswamy; A. W. Karambelas

[57] ABSTRACT

Antenna structure 10 has a primary reflective surface 12 over which is positioned a subreflector surface 14. Support webs 32, 34 and 36 are made of low dielectric loss insulating material and are adhesively secured in slots in the reflectors. The support webs are positioned on planes through the axis so that the small thickness of the webs is in the projected area and results in an unobstructed and undistorted electromagnetic radiation pattern. The webs firmly support the subreflector in the desired position. The antenna can be configured as a Gregorian system as shown or alternatively as a Cassegrainian system.

6 Claims, 3 Drawing Figures

Fig. 1.
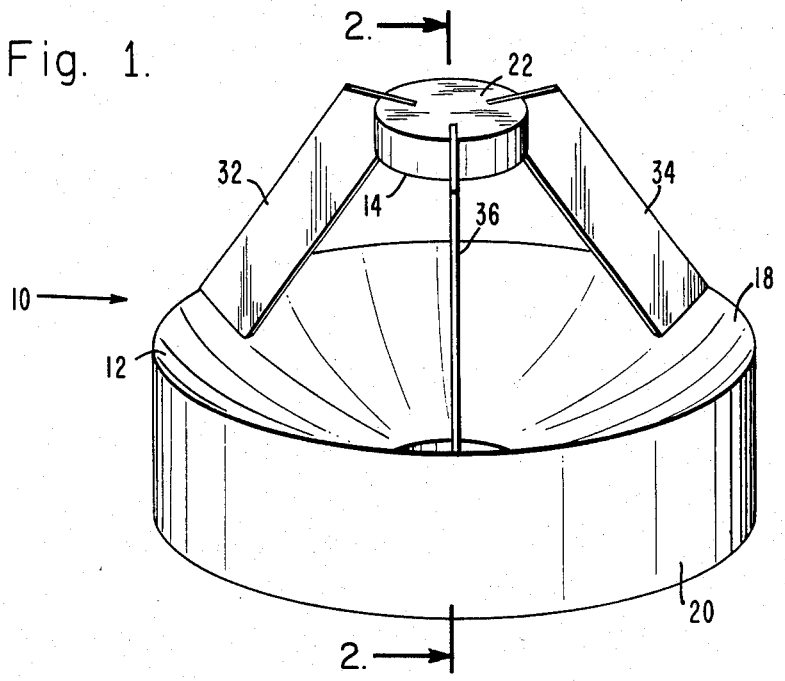
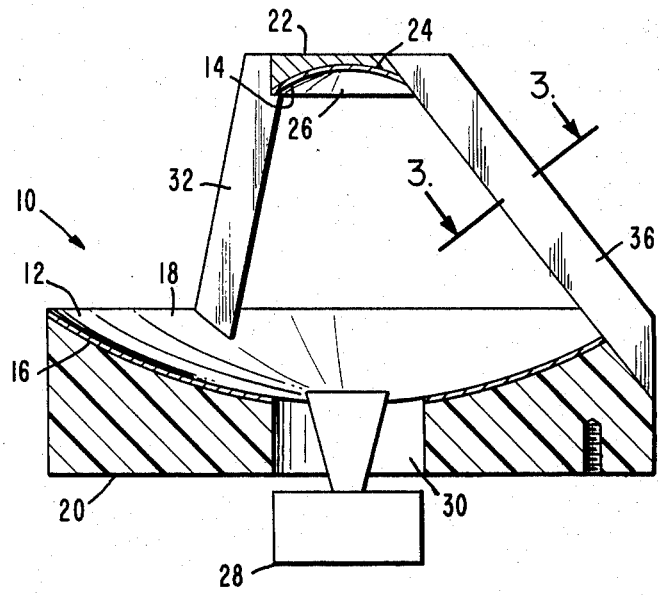
Fig. 2.
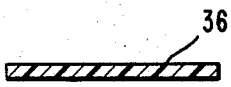
Fig. 3.

MULTIPLE REFLECTOR SYSTEM WITH DIELECTRIC SUPPORT WEBS AND FOAM BODY

BACKGROUND OF THE INVENTION

The present invention relates to a novel reflector structure in general and particularly to a strong, lightweight Cassegrain or Gregorian antenna for millimeter wavelength electromagnetic radiation.

When employed as transmitter antennas for millimeter wave electromagnetic radiation along an axis, the radiation feed faces forward on the axis and a small subreflector on the axis redirects the radiation onto a large forward looking primary reflector. In the Gregorian antenna, the subreflector is a concave ellipsoid and the primary reflector is a paraboloid. In a Cassegrainian system, the subreflector is a convex hyperboloid and the primary reflector is a paraboloid. The Cassegrainian system is superior because of its shorter overall length, and the Gregorian system is superior because the concave reflector surfaces are more easily fabricated.

The subreflector is supported in a fixed dimensional relationship with respect to the primary reflector to maintain the focal points of the primary and subreflectors in proper geometric alignment for successful antenna operation. Some examples in the prior art of the manner in which the subreflectors are mounted are shown in Ratkevich U.S. Pat. No. 2,942,264, Wild et al U.S. Pat. No. 2,945,233, Kibler U.S. Pat. No. 3,611,393, and Salmond et al U.S. Pat. No. 4,095,230. The Ratkevich patent shows the subreflector mounted upon an axial tube which is positioned in the radiation path. The other patents show the subreflector supported on legs which intercept a smaller portion of the projected area of the primary reflector. Except for the fact that there are at least three legs supporting the subreflector, no special structural interrelationship is taught.

SUMMARY OF THE INVENTION

In order to aid in the understanding of this invention it can be stated in essentially summary form that it is directed to the support of a subreflector with respect to the primary reflector of a Cassegrain or Gregorian antenna. The support is provided by preferably three webs of flat, thin dielectric material which lie on divergent radial planes and are secured to both reflectors. The combination of low electric loss in the dielectric webs and minimal physical beam obstruction result in an unobstructed and undistorted radiation pattern of the Cassegrain or Gregorian antenna.

It is thus the purpose and advantage of this invention to provide a strong, lightweight Cassegrain or Gregorian antenna structure for millimeter wave electromagnetic radiation wherein the subreflector is firmly and accurately supported with respect to the primary reflector. It is a further purpose and advantage to provide an antenna structure wherein preferably three webs of low dielectric loss material are secured to both the subreflector and primary reflector of a Cassegrain or Gregorian antenna to support the subreflector with respect to the primary reflector, with the low electric loss of the web material and minimal beam obstruction providing an obstructed and undistorted radiation pattern. It is another purpose and advantage of this invention to provide a firm support that maintains the surfaces of revolution of the primary and the subreflector in coaxial alignment.

Other purposes and advantages of this invention will become apparent from the study of the following portion of the specification, the claims and the attached drawings.

BRIEF DESCRIPTION OF THE DRAWINGS

FIG. 1 is a perspective view of the antenna structure of this invention.

FIG. 2 is a section taken generally along the line 2—2 of FIG. 1.

FIG. 3 is a section through one of the supporting webs, taken generally along the line 3—3 of FIG. 2.

DETAILED DESCRIPTION OF THE INVENTION

Antenna structure 10 is comprised of a primary reflector 12 and a subreflector 14. The antenna structure 10 and its reflectors are illustrated as being Gregorian, but as the detailed description proceeds, it is seen that the surfaces could be configured for a Cassegrainian optical structure. Since the antenna structure 10 is designed for millimeter wave electromagnetic radiation, the reflectors are metallic surfaces with good electrical conductivity. As is seen in FIG. 2, primary reflector 12 comprises a thin metallic sheet 16 which is shaped so that its front surface 18 is parabolic about a central axis. The axis is upright in FIG. 2 and through the center of the reflectors 12 and 14. In order to rigidize the thin metallic sheet 16 and maintain the precise desired paraboloid surface with a minimum of metal and weight, while providing maximized strength, a rigid foamed polymer composition material body 20 is provided. The body 20 is shaped to hold the metallic sheet 16 in the desired configuration and the sheet 16 is rigidly secured to the body. Together, the primary reflector structure is comprised of the configured metallic sheet and the foam body which supports it.

Subreflector 14 also has a foam body 22 to which is secured shaped electrically conductive metallic sheet 24. The metallic sheet 24 has a curved surface 26 which provides the reflector function.

A preferred method for making this reflector structure is my invention and is described in detail in my copending patent application entitled "Method and Tool for Forming Precisely Curved Surfaces", Ser. No. 106,986 filed Dec. 6, 1979. The entire disclosure of that application is incorporated herein by this reference.

When the antenna structure 10 is used as transmitting millimeter wave antenna, transmitter 28 is a radiation device emitting radiation through opening 30 in primary reflector 12. The radiation reflects on subreflector 14 back to the primary reflector 12. When properly positioned, the far focus of the elliptical reflector surface of subreflector 14 coincides with the focus of the parabolic primary reflector 12, in the Gregorian structure illustrated. The microwave radiator of transmitter 28 lies near this focus of the elliptical subreflector surface. These focus points are located on the central axis of the antenna structure. It is important that the subreflector 14 be firmly maintained in it's position, and it is also important that the structure that maintains it in position does not interfere with or obstruct the energy radiation pattern of the primary reflector. In addition to employing the antenna structure as a part of a transmitter system, it is equally applicable to a receiving antenna with a radiation sensing device which is acted on by incoming radiation.

Support webs 32, 34 and 36 are arms which are secured to both the subreflector and primary reflector to support the subreflector with respect to the primary reflector without obstructing or distorting the radiation pattern. It is the configuration of these support webs in association with the balance of the antenna structure which produces the desirable antenna properties. The firm positioning of subreflector 14 at the proper position enhances radiation efficiency.

Support webs 32, 34 and 36 are each thin in the thickness direction, which is the upright direction in FIG. 3. They are wide in the lateral direction, which is transverse in FIG. 3. The webs are positioned in slots in the two reflectors, as is seen in FIGS. 1 and 2 and are secured therein by means of dielectric adhesive. The material of the support webs is of low dielectric loss. Fiber glass in epoxy is a suitable structure. The thickness of the webs is preferably from 0.001 to 0.007 aperture diameters, where the aperture diameter is the diameter of primary reflector 12 perpendicular to its axis. As is seen in FIG. 1, the reflectors are preferably circular in configuration. This small thickness of the support webs provides little physical obstruction of the aperture represented by the unobstructed forward projected area of the primary reflector. The width of the web 32, 34 and 36 is preferably from about 0.05 to 0.1 aperture diameters. These thickness and width dimensions provide width to thickness ratios from about 7 to about 100. These dimensions provide stiffness along the length of the support webs and across the width direction, and adequate stiffness in the thickness direction to provide adequate resistance against rotation of the subreflector around the axis.

The webs are cemented into accurately located peripheral slots on the primary reflector and subreflector. They are positioned so that they lie in equiangularly spaced planes which are radial through the axis. In this way, minimized projected area of the webs is provided. The material of the webs is of low electric loss and this characteristic together with the minimal beam obstruction, results in an unobstructed and undistorted radiation pattern of the antenna.

This lamellar support structure of the subreflector permits small torsional movements of the subreflector in relation to the primary reflector. However, the focal distance is firmly and rigidly fixed because there is no freedom of movement in the axial direction. Furthermore, since there is no freedom of movement of the subreflector with respect to the primary reflector in an off axis direction, the optical and dimensional relationship of the feed and reflectors are maintained. The result is a strong, efficient, lightweight antenna structure.

This invention has been described in its presently contemplated best mode and it is clear that it is susceptible to numerous modifications, modes and embodiments within the ability of those skilled in the art and without the exercise of the inventive faculty. Accordingly, the scope of this invention is defined by the scope of the following claims.

What is claimed is:

1. An antenna structure comprising:

a primary reflector having a reflective surface which is shaped as a surface of revolution about an axis, said axis being the axis of said primary reflector, said reflector surface being supported on a foam body, and having an opening through said primary reflector and said foam body on said axis;

a subreflector having a reflective surface which is a surface of revolution about a second axis, with said two axes positioned substantially colinear, said subreflector positioned with respect to said opening in said primary reflector such that radiation reflects on both said primary reflector and said subreflector;

at least three slots in each of said primary reflector and said subreflector, said slots lying substantially on planes passing through said axis of said primary reflector, with respective ones of said slots in said subreflector lying on the same plane through said primary reflector axis as respective ones of said slots in said primary reflector, said slots in said primary reflector extending into said foam body;

a plurality of support webs of low loss dielectric material between said reflectors for maintaining said subreflector at a substantially fixed distance away from said primary reflector and for maintaining said axes so that they lie substantially together, said support webs being of substantial width in a direction normal to said axes and substantially thin in a direction circumferential to said axes, and having a width to thickness ratio between about 7 and about 100, the thickness of said webs being on the order of between 0.001 and 0.007 times the aperture diameter where the diameter of said primary reflector is the aperture diameter of said antenna, said support webs being mounted in said slots.

2. The antenna structure of claim 1 wherein the width of said webs is between 0.05 and 0.1 times the aperture diameter.

3. The antenna structure of claim 2 wherein there is an axial opening in said primary reflector and said subreflector has a focus on said axis at said opening and wherein a radiation device is positioned at said opening adjacent said focus.

4. The antenna structure of claim 1 wherein said support webs comprise a substantially homogeneous composition of glass fibers embedded in an epoxy binder.

5. An antenna structure comprising:

a primary reflector having a reflective surface which is shaped as a surface of revolution about an axis, said axis being the axis of said primary reflector, said reflector surface being supported on a foam body, said reflector surface having a diameter across said axis which is the aperture diameter, and an opening through said primary reflector and its body on said axis;

a subreflector having a second surface of revolution about said axis, said axis forming a central axis of said antenna structure, said subreflector facing said opening in said primary reflector so that radiation reflects on both said primary reflector and said subreflector;

at least three slots in each of said primary reflector and said subreflector, said slots lying substantially on planes passing through said axis, with one of said slots in said subreflector lying on the same plane through said axis as one of said slots in said primary reflector, said slots in said primary reflector extending into said foam body;

at least three support webs of low electric loss material rigidly mounted in said slots using low electric loss adhesive material and extending into said foam body, said support webs having a width to thickness ratio of between about 7 and about 100, said support webs being secured in said slots so that each of said support webs lie in a plane passing through said axis so that said support webs firmly support said subreflector with respect to said primary reflector.

6. The antenna structure of claim 5 wherein said webs comprise epoxy impregnated fiberglass.

* * * * *